US006011571A

United States Patent [19]

Lardant et al.

[11] Patent Number: 6,011,571

[45] Date of Patent: Jan. 4, 2000

[54] CONVERTIBLE THERMAL PRINTING MECHANISM

[75] Inventors: Patrick Lardant, Paris; Pascal Pierre-Francois, Saint-Germain-les-Arpajon, both of France

[73] Assignee: Investix, S.A., Paris, France

[21] Appl. No.: 09/000,358

[22] PCT Filed: Jul. 29, 1996

[86] PCT No.: PCT/FR96/01193

§ 371 Date: Jan. 28, 1998

§ 102(e) Date: Jan. 28, 1998

[87] PCT Pub. No.: WO97/04966

PCT Pub. Date: Feb. 13, 1997

[30] Foreign Application Priority Data

Jul. 28, 1995 [FR] France ..... 95 09245
May 24, 1996 [FR] France ..... 96 06498

[51] Int. Cl.[7] ..... B41J 25/304

[52] U.S. Cl. ..... 347/197

[58] Field of Search ..... 347/197, 222, 347/104, 220; 400/120.16, 691, 692, 693

[56] References Cited

U.S. PATENT DOCUMENTS 5,030,968 7/1991 Benson et al. ..... 347/222
5,133,611 7/1992 Nakajima ..... 400/120.16
5,139,351 8/1992 Kamada ..... 400/120.16
5,198,836 3/1993 Saito et al. ..... 347/222
5,579,043 11/1996 Patry ..... 347/222

FOREIGN PATENT DOCUMENTS 39 43 239 6/1991 Germany .

*Primary Examiner*—N. Le
*Assistant Examiner*—Judy Nguyen
*Attorney, Agent, or Firm*—Blakely, Sokoloff, Taylor & Zafman

[57] ABSTRACT

A thermal printer mechanism comprising an elongate support (1), a drive roller (4), a strip of print elements (3) mounted on said support, spring-forming means for urging said strip against the drive roller, at least one cam (5) mounted to pivot about an axis ($A_2$) of the support (1) to move the strip (3) away from the drive roller (4), said mechanism being characterized in that it can be transformed from a stationary-roller version to a retractable-roller version, and in that the axle about which the drive roller (4) rotates is suitable for being selectively mounted either on the support (1), or on a paper-protecting cover (CP) hinged to said support (1), the cam of the stationary version being suitable for being replaced with at least one other cam suitable for being entrained by the paper-protecting cover being tipped up and vice versa.

6 Claims, 3 Drawing Sheets

CONVERTIBLE THERMAL PRINTING MECHANISM

FIELD OF THE INVENTION

The present invention relates to a transformable thermal printer mechanism for printing on heat-sensitive paper.

BACKGROUND

Thermal printer mechanisms having stationary rollers are already known. Such a mechanism includes:

an elongate support;

a part mounted to pivot about an axis at the back of the support, which part carries a print strip extending in the length direction of the support;

a roller which is rotatably mounted on side plates provided on the support, and which extends facing the print strip; and one or more side cams mounted to pivot about an axis at the front of the support, the cams serving to raise the part that carries the print strip to enable the paper to be inserted between said strip and the roller when changing the feed roll.

Printers having retractable rollers are also known. In such a printer, the drive roller is not stationary relative to the support, but rather it is mounted on a mechanism whose moving parts enable the roller to be moved away from its operating position on opening the cover of the paper well, so as to provide easy access to said drive roller for putting a strip of paper back in place thereabout.

SUMMARY

An object of the invention is to provide a dual-purpose structure which makes it possible to go from a stationary-roller printer mechanism to a retractable-roller printer mechanism by performing only a small number of operations and by changing only a small number of parts.

To this end, the invention provides a thermal printer mechanism comprising an elongate support, a drive roller, a strip of print elements mounted on said support, spring-forming means for urging said strip against the drive roller, at least one cam mounted to pivot about an axis of the support to move the strip away from the drive roller, said mechanism being characterized in that it can be transformed from a stationary-roller version to a retractable-roller version, and in that the axle about which the drive roller rotates is suitable for being selectively mounted either on the support, or on a paper-protecting cover hinged to said support, the cam of the stationary version being suitable for being replaced with at least one other cam suitable for being entrained by the paper-protecting cover being tipped up and vice versa.

Various design options are possible for the appearance of the cover provided that the hinge point lies in a precise zone, it thus being possible to design a paper storage chamber of capacity that can be different depending on the embodiments, but that, in all cases, makes it easy to insert the paper.

Advantageously, the cam of the stationary version is suitable for being replaced, in the retractable version, with two cams, one of which enables the print head to be lifted away from the roller as the paper-protecting cover starts to tip up, the other cam being entrained by the axle of the drive roller as said roller is displaced with the paper-protecting cover so as to continue to raise the print head.

Also advantageously, in the retractable-roller version, the axle of the roller is received in slots provided in the paper-protecting cover, said slots co-operating with the support to hold the axle of the roller in its printing operating position, when the cover is closed, said slots receiving, in the stationary-roller version, bearings on which the roller is rotatably mounted.

BRIEF DESCRIPTION OF THE DRAWINGS

Other characteristics and advantages of the invention appear from the following description given purely by way of non-limiting example and with reference to the accompanying drawings, in which.

DETAILED DESCRIPTION

Figure 1:
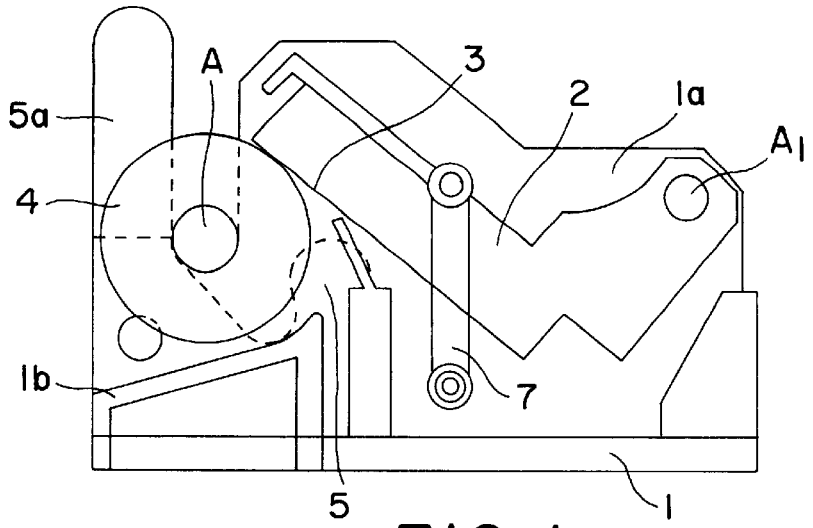
FIG. 1 is a section view of a stationary-roller version of a possible embodiment of a printer mechanism of the invention.
Figure 2:
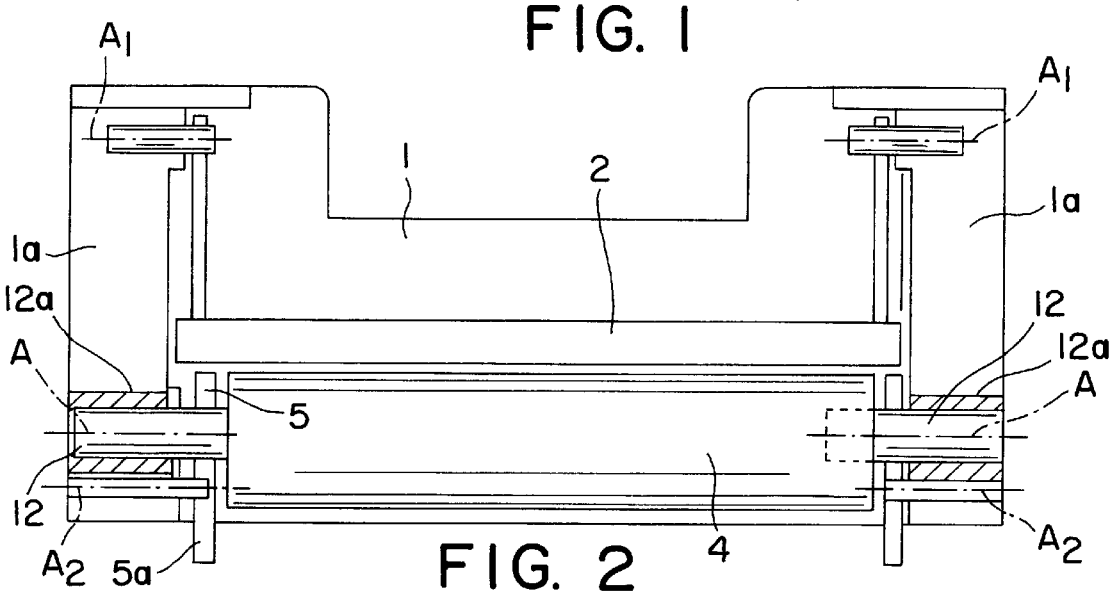
FIG. 2 is a plan view of the mechanism.

The printer mechanism shown in FIGS. 1 and 2 (stationary version) mainly comprises:

an elongate support 1 which has two side plates 1*a*;

an elongate part 2 which carries a strip 3 of thermal print elements and which is mounted to pivot on the side plates 1*a* about an axis $A_1$ in the vicinity of the back of the support 1;

a drive roller 4 which, in the stationary-roller version, is mounted to rotate about an axis A via two end stub axle rings 12 in bearings 12*a* provided in the side plates 1*a*, said roller facing the strip 3, and being rotated by a motor (not shown) to which it is connected via gearing;

a side cam 5 mounted to pivot about an axis $A_2$ in the vicinity of the front of the support 1 and serving, on being tipped up, to raise the part 2 and the print strip 3; and two return springs 7 that urge the part 2 carrying the strip 3 towards the support 1.

It should be noted that in the present text, the adjectives "back" and "front" are to be understood relative to the respective positions of the drive roller 4 and of the strip 3 in the printing position, the strip then being situated behind the axis of the roller 3.

In this version (stationary drive roller 4), the paper from the feed roll is inserted around the drive roller 4 as follows.

An operator tips up the cam 5 by acting on a lever arm 5*a* that terminates it, thereby raising the print strip 3 relative to the drive roller 4.

The paper from the feed roll is inserted via a guide ramp 1*b* provided on the support 1, and it is guided about the roller 4 by the guide 1*b* and by the shape of the printer mechanism.

Once the operation is finished, the operator tips the cam 5 back in the opposite direction so that the print strip 3, which is urged towards the support 1 by the return springs 7, bears down against the paper.

It is easy to modify this printer mechanism to transform it to a retractable-roller structure.

In the retractable-roller configuration, a cover CP for protecting the roll of paper is mounted to pivot about an axis that is stationary relative to the support.

The cam 5 is replaced with two side cams 8 and 9 mounted to pivot about the axis $A_2$ at the front of the support 1.

Figure 3:
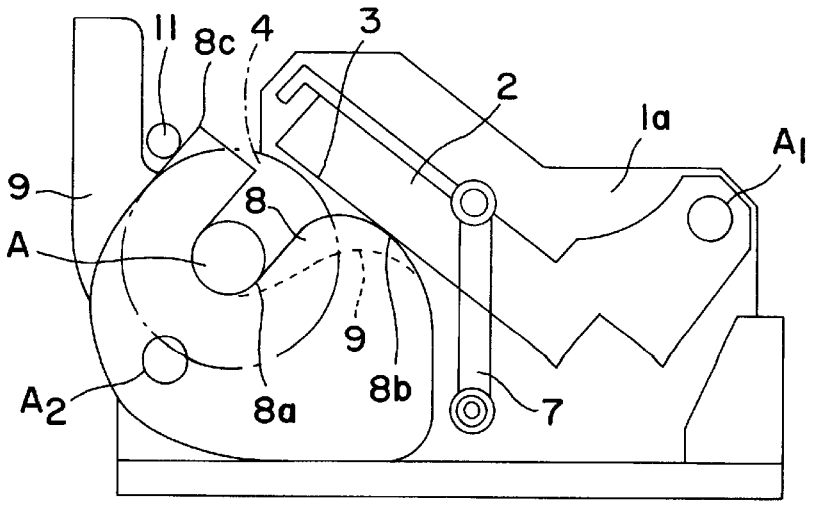
FIG. 3 is a view similar to FIG. 1, but showing a retractable-roller version of the printer mechanism.

The assembly is then as shown in FIG. 3.

The operator goes from one version to the other by removing the side plates 1*a* from the support 1 to extract the drive roller 4, by removing the bearings 12*a* from said side plates 1*a,* then, after re-installing the side plates 1*a,* by integrating the support 1, for example, into a molded body to which the paper-protecting cover CP is hinged.

Figure 4A:
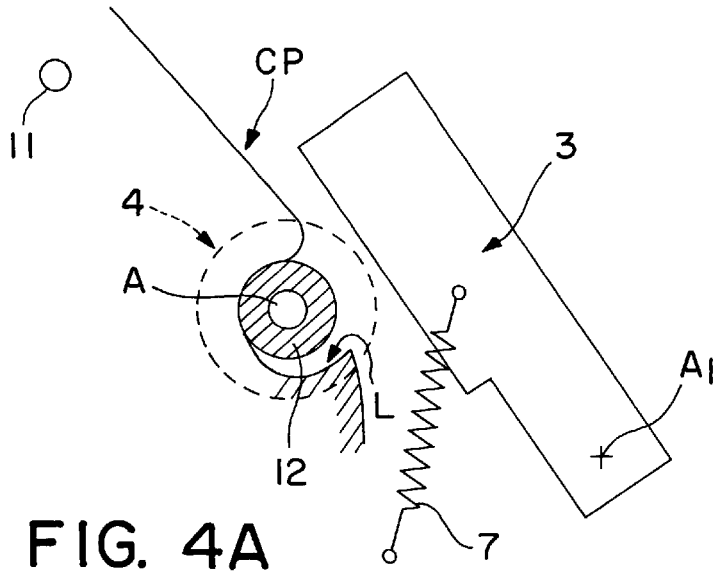
FIG. 4*a* is a section view of the sides of the paper-protecting cover on which the roller is mounted in the retractable version of the mechanism.
Figure 4B:
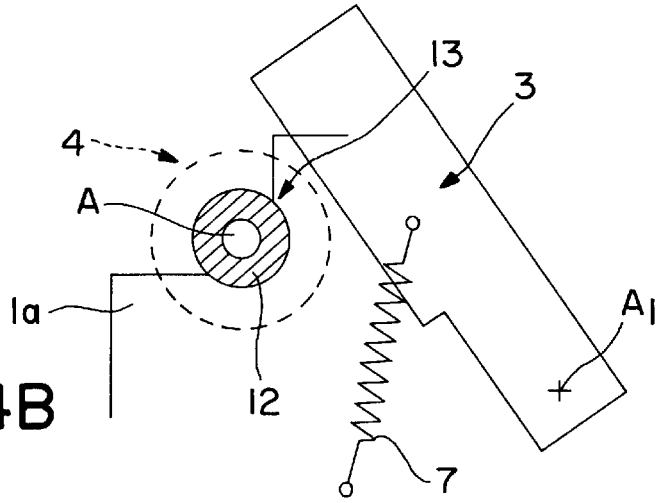
FIG. 4*b* is a section view of the side plates of the support in the retractable version of the mechanism.
Figure 4C:
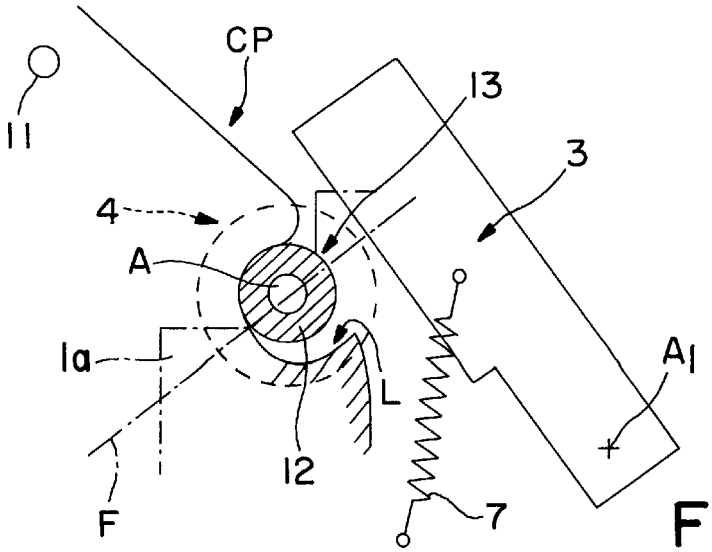
FIG. 4*c* is a section view showing the sides of the paper-protecting cover shown in FIG. 4*a* and the side plates of the support shown in FIG. 4*b*.

As shown in FIGS. 4*a* to 4*c,* the axis A of the roller 4 is then no longer stationary relative to the side plates, but rather it is terminated by the stub axle rings 12 which pass through said side plates 1*a* via slots 13 (FIG. 4*b*) that are provided in said side plates and that allow the roller 4 to be displaced as described in more detail below. The slots 13 are open to the front of the printer mechanism. The bearings 12*a* are mounted in these slots 13 in the stationary version shown in FIGS. 1 and 2.

The stub axle rings 12 are also received in slots L that are provided in the sides of the cover CP (FIG. 4*a*), and that, together with the slots 13, contribute to maintaining the stub axle rings 12 and said axis A in their operating position for printing when the cover CP is closed. These slots L are open to the back of the printer mechanism.

The shapes and dimensions of the slots 13 and L and of the stub axle rings 12 are such that, in the position corresponding to printing operation, the head 3 presses against the roller 4 by exerting a radial force thereagainst. FIG. 4*c* shows the direction F of this force. The plane of the forces exerted by the head 3 on the roller 4 includes the contact points where the axle of said drive roller is in contact with the end walls of the slots.

Figure 5:
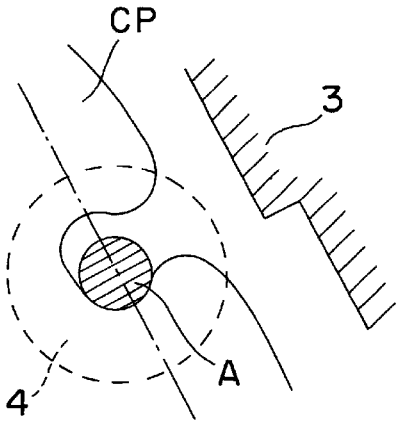
FIG. 5 is a section view of a side of the paper-protecting cover showing the roller-retracting stage.

To remove or to install a roll of paper, the cover CP is tipped up about its hinge axis which must be situated in a zone Z1 defined by the shapes of the side plates 1*a,* and by the displacement of the thermal head 3 (FIG. 5).

The cover is tipped up in two stages, namely a first stage enabling the thermal point head 3 to be moved away from the roller 4 so as not to damage said head, and a second stage enabling the roller 4 to be displaced so as to raise it (paper-protecting cover fully open).

During the first stage, as the cover CP starts to tip up, a stud 11 provided on said cover CP (FIGS. 3, 4*a,* 4*c*) comes into abutment against a lever portion of the cam 9, thereby pivoting said cam about its axis $A_2$.

A lobe provided on said cam 9 acts against the part 2 that carries the print head 3 and moves said head away from the roller 4.

The axle A of the roller 4 is carried by the end walls of the slots 13 in the side plates la and remains stationary.

Moving the head 3 out of the way makes it possible to prevent it from rubbing against the roller 4 when said roller starts to be displaced.

The roller 4 starts to be displaced when the lower portions of the end walls of the slots L come into contact with the axle A and raise it (FIG. 5). The roller 4 is then entrained with the cover CP.

Figure 6:
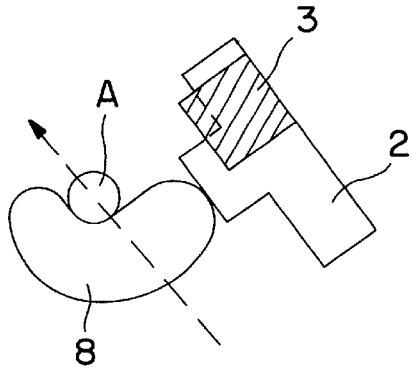
FIG. 6 shows the stage during which the thermal head support is rotated and raised fully.

While the roller 4 is being displaced, one of the stub axle rings 12 comes into abutment against the cam 8 and tips it about the axis $A_2$. This tipping of the cam 8 then enables the thermal print head 3 to be fully raised and to be held in this set position (FIG. 6);

Once the cover CP is fully tipped up, the zone of the roller 4 is fully accessible to the operator.

Once the roll is in place in the paper well, and the paper is disposed correctly about the drive roller, the cover CP is closed again. The stud 11 comes into abutment against a bearing surface 8*c* of the cam 8 so as to tip the cams 8 and 9 back in the opposite direction relative to the opening operation. In a first stage, the cams 8 and 9 are tipped back so that the roller 4 is returned to its operating position, with the paper being disposed between the roller and the thermal print strip.

In a second stage, the cam 9 continues its stroke so that the thermal print head 3 is pressed against the roller in its printing position.

Thus, with the same structure, and merely by changing the cams, it is possible to provide either a stationary-roller printer mechanism or a retractable-roller printer mechanism.

As will have been understood, it is possible to go from one version to the other by acting on a very small number of parts: the cam 5 is replaced with the cams 8 and 9, and the bearings 12*a* mounted on the side plates are removed to cause the slots 13 to appear.

This dual-purpose technique makes it possible for a manufacturer (manufacturing printers or cash registers) who has procured a stationary-roller version of a printer mechanism to go over subsequently to a retractable-roller version more cheaply, or else to have a single printer mechanism reference for designing a full stationary-roller system and a full retractable-roller system without having to change the electronics associated with either of the versions. Choosing a thermal printer mechanism essentially depends on how it is integrated into an industrial process: a stationary-roller printer mechanism might be chosen for reasons of miniaturization or because it is to be inserted into an existing piece of equipment, whereas a retractable-roller printer mechanism might be preferred for designing a finished product in which the ease with which the paper can be inserted is the most important factor. The present invention makes it possible for a single product to satisfy all of these requirements, or even to go from one requirement to another.

Numerous shapes may be considered for the paper well associated with the retractable version.

It is necessary merely to satisfy the displacement constraints, and in particular the constraint whereby the hinge axis of the cover of the paper well must be situated in the zone Z1 defined relative to the support 1. Naturally, these constraints are indicated to the operators to whom the printer mechanism is delivered in its stationary version.

Figure 7A:
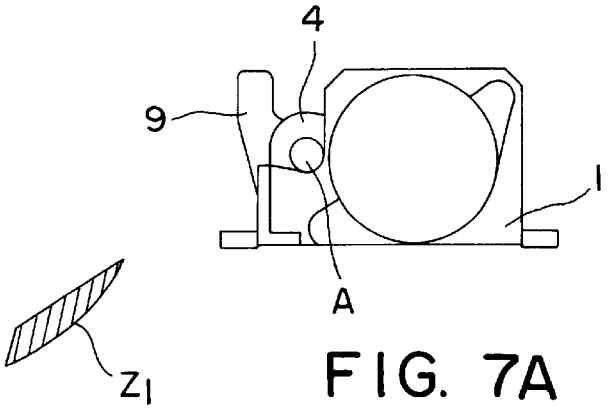
FIGS. 7*a* and 7*b* are diagrammatic side views of the retractable version of the printer mechanism of the invention showing the zone in which the axis of rotation of the cover must be situated.
Figure 7B:
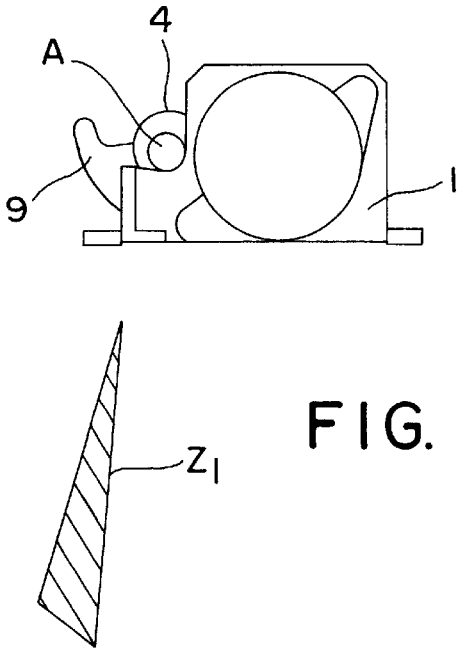

Possible shapes for the zone Z1 are shown in FIGS. 7*a* and 7*b*.

Advantageously, the part which carries the print head is designed such that it can support a plurality of types of print head.

Likewise, the printer mechanism structure proposed by the invention may naturally be proposed for a plurality of paper widths, only the length of the support and possibly the length of the print head then being changed, the side parts and in particular the cams then not being changed.

In a variant, it is possible to use the same basic mechanism in its stationary-roller version or in its retractable-roller version to print on heat-sensitive paper of different widths.

Apparatus is used that makes it possible to maintain proper guiding of the paper during printing.

In a stationary-roller mechanism, the paper is guided between two sides.

One of the two sides is stationary relative to the support, and it serves as a reference for guiding the paper and for positioning the printing relative to the left edge of the paper.

The other side is implemented in the form of a removable deflector.

This deflector, whose position can be adjusted manually, makes it possible to obtain a given distance between the sides, and enables the paper to be guided effectively during printing.

The basic design of the support makes it possible to integrate or to omit the deflector depending on the requirements of the customer.

The deflector may take up a multitude of positions. It is held in position by a fixed-pitch latch system.

When the mechanism is a retractable-roller mechanism, a side plate is fitted on the deflector so as to put the roll of paper in a reference position and so as to guide it in the compartment provided for it.

This system makes it possible to adjust the position of the roll of paper after it has been inserted.

We claim:

1. A thermal printer mechanism, comprising:

an elongate support, a drive roller, a print head mounted on said support, spring-forming means for urging said head against the drive roller, at least a first cam configured to pivotally mount about an axis of the support to move the print head away from the drive roller, and an axle supporting the drive roller to rotate selectively mounted either only on the support, or on both the support and a paper-protecting cover hinged to said supported; wherein the drive roller is non-retractable when said axle is mounted only on the support; and wherein said first cam is replaced by a second cam configured to retract the drive roller when said axle is mounted on both the support and the paper-protecting cover.

2. A mechanism according to claim 1 wherein the second cam includes two cams, one of which is configured to enable the print head to be moved away from the roller as the paper-protecting cover starts to tip up, the other cam is configured to enable the print head to be lifted away from the drive roller as the paper-protecting cover continues to raise up.

3. A mechanism according to claim 1 or 2, wherein the axle is received in slots provided in the support and paper-protecting cover, said slots hold the axle in printing operating position when the cover is closed, said slots of the supports receive therein bearings when the axle is mounted only on the support.

4. A mechanism according to claim 3, wherein said slot provided in the paper-protecting cover are dimensionally configured such that, when the drive roller is in the printing operating position, a plane of the force exerted by the print head on the drive roller includes contact points at which the axle is in contact with the end walls of said sots.

5. A mechanism according to claim 3, wherein the slots are open to the side of the cover.

6. A mechanism according to claim 1, wherein the print head is replaceable by another print head adapted to accommodate a plurality of paper widths.

* * * * *

UNITED STATES PATENT AND TRADEMARK OFFICE

CERTIFICATE OF CORRECTION

PATENT NO. : 6,011,571

DATED : January 4, 2000

INVENTOR(S) : Lardant et al.

It is certified that error appears in the above-identified patent and that said Letters Patent is hereby corrected as shown below:

In [54], line 1-2, delete "CONVERTIBLE THERMAL PRINTING MECHANISM" and insert -- A TRANSFORMABLE THERMAL PRINTING MECHANISM --.

In column 1, line 1-2, delete "CONVERTIBLE THERMAL PRINTING MECHANISM," and insert -- A TRANSFORMABLE THERMAL PRINTING MECHANISM --.

In column 3, line 51, delete "the thermal point head" and insert -- the thermal print head --.

In column 3, line 63, delete "side plates la" and insert -- side plates 1*a* --.

In column 6, line 1 delete "supported; wherein" and insert -- support; wherein --.

In column 6, line 7, delete "according to claim 1 wherein" and insert -- according to claim 1, wherein --.

In column 6, line 20, delete "wherein said slot" and insert -- wherein said slots --.

UNITED STATES PATENT AND TRADEMARK OFFICE

CERTIFICATE OF CORRECTION

PATENT NO. : 6,011,571

DATED : January 4, 2000

INVENTOR(S) : Lardant et al.

It is certified that error appears in the above-identified patent and that said Letters Patent is hereby corrected as shown below:

In column 6, line 25, delete "the end walls of said sots" and insert -- the end walls of said slots --.

In column 6, line 27, delete "to the side of the cover" and insert -- to the sides of the cover --.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*